US005287827A

United States Patent [19]

Almendinger et al.

[11] Patent Number: 5,287,827

[45] Date of Patent: Feb. 22, 1994

[54] FREE PISTON ENGINE CONTROL SYSTEM

[75] Inventors: Allen D. Almendinger, Bloomington; Timothy S. Anderson, Deceased Late of St. Michael; By Tina P. Anderson, St. Michael, Administratrix; Anton Braun, Minneapolis; William J. Zerull, Edina, all of Minn.

[73] Assignee: Tectonics Companies, Inc., Minneapolis, Minn.

[21] Appl. No.: 761,252

[22] Filed: Sep. 17, 1991

[51] Int. Cl.[5] ..... F02B 71/00

[52] U.S. Cl. ..... 123/46 R

[58] Field of Search ..... 123/46 R, 46 A, 46 E; 417/11

[56] References Cited

U.S. PATENT DOCUMENTS

| | | | |
|---|---|---|---|
| 3,446,197 | 5/1969 | Sorensen et al. . | |
| 3,643,638 | 2/1972 | Braun | 123/46 R |
| 3,673,999 | 7/1972 | Lacy et al. | 123/46 R |
| 3,722,481 | 3/1973 | Braun | 123/179.16 |
| 3,841,797 | 10/1974 | Fitzgerald | 123/46 R |
| 4,087,205 | 5/1978 | Heintz | 417/11 |
| 4,382,748 | 5/1983 | Vanderlaan | 417/314 |
| 4,589,380 | 5/1986 | Coad | 123/46 R |
| 4,653,273 | 3/1987 | David | 123/46 A |
| 4,653,274 | 3/1987 | David | 123/46 A |
| 4,665,703 | 5/1987 | David | 123/46 R |
| 4,876,991 | 10/1989 | Galitello | 123/46 E |
| 4,924,956 | 5/1990 | Deng et al. | 123/46 E |

FOREIGN PATENT DOCUMENTS

| | | |
|---|---|---|
| 3139357 | 4/1983 | Denmark . |
| WO87/01161 | 2/1987 | PCT Int'l Appl. . |
| 2219671A | 12/1989 | United Kingdom . |

*Primary Examiner*—David A. Okonsky

*Attorney, Agent, or Firm*—Merchant, Gould, Smith, Edell, Welter & Schmidt

[57] ABSTRACT

A control system for a variable stroke free piston engine, sets the ignition timing as a function of measured piston velocity. This velocity proportional ignition system provides spark advance on a stroke by stroke basis as an aid to starting the engine. Ignition changes over to a piston position based system when the engine is running at steady state. Fuel injection occurs at either piston dead point or is set as a function of piston position. Fuel injection is suppressed during cycles were the ports are not uncovered. The control system can also regulate compression ratio based upon piston position or knock sensor data. The preferred control system includes a hybrid digital analog system which includes a microprocessor.

10 Claims, 11 Drawing Sheets

EML
0
543
538
590
540
534
535
531
527
528
542
526
524
516
514
EDP
529
513
515
512
518
517
519
530
525
520
522
523
521
541
532
537
536
533
511
510
0
CML
START-UP IGNITION
START-UP INJECTOR
INWARD
OUTWARD
EXHAUST OPENS
TRANSFER OPENS
STROKE POSITION
VELOCITY

IGNITION

COMPRESSION RATIO CONTROL

FUEL INJECTION

AJUSTABLE POSTION FUEL INJECTION MARKER
1215
START-UP FUEL INJECTION MARKER
1216
PORT OPENING DETECTION
1217
DETERMINE INJECTOR DURATION 1210
1214
PORTS OPEN LAST STROKE
NO
1218
YES
OPEN FUEL INJECTOR VALVE 1211
START TIMER 1212
EXIT TO EXECUTIVE 910
1219
CLOSE INJECTOR 1213
TIMER EXPIRATION
1220
1221
EXIT TO EXECUTIVE 910

FREE PISTON ENGINE CONTROL SYSTEM

BACKGROUND OF THE INVENTION

1. Field of The Invention

The present invention relates to free piston engines, and more particularly, to a control system which supplies ignition timing, injection timing, and compression ratio modification information to operate the engine.

2. Brief Description of The Prior Art

Free piston engines are well known in the art. U.S. Pat. Nos. 4,896,632; 4,782,796 and 4,046,115 to Anton Braun, illustrate engines of this type.

It is important to recognize that free piston engines lack both the crankshaft and flywheel structures, which are found in more conventional engines.

The absence of a crankshaft introduces additional degrees of freedom into the operation of free piston engines, and both the stroke length and compression ratio are variables which may be adjusted in a free piston engine.

The absence of a flywheel, limits the amount of energy stored in the system to the relatively small amount of energy which may be stored in the compressor section of the system. This factor renders the free piston engine more sensitive to transient or irregular operating conditions, than crank based engines. For example, in certain free piston engines, a single misfire can cause the engine to stop running.

The absence of a crankshaft and flywheel assembly, also eliminates convenient access to piston position information. This has rendered ignition timing and injection timing parameters difficult to accommodate, in free piston engines. As a consequence, stable engine operation has been difficult to achieve.

These problems are well known in the art and several of them have been addressed. For example, one approach to controlling the ignition timing of a free piston engine, is know from U.S. Pat. No. 3,673,999 to Lacy and Byrne. In this engine, a magnet is coupled to the reciprocating rod of the engine. The magnet moves past the fixed coil which converts rod motion into a velocity dependent voltage signal. In this prior art arrangement, the AC waveform produced by the coil is used to determine the stroke reversal point of the engine. The stroke reversal point is taken as the appropriate ignition timing mark for the engine.

Another approach to controlling ignition timing in a free piston engine is known from U.S. Pat. No. 3,643,638 to Anton Braun. This patent teaches the use of a secondary engine parameter to determine the piston stroke reversal point for ignition timing.

However in spite of these advances, the ability to regulate and control a free piston engine in response to variations in load, as well as the ability to compensate for irregular operating conditions, have proved difficult in this art and has limited the acceptance of this type of engine.

SUMMARY OF THE INVENTION

In one aspect, the free piston engine control system of the present invention generates several candidate ignition and injection timing markers. The control system selects between these various markers based upon the operating state of the engine.

In an illustrative and preferred example, the control system generates three ignition timing markers and three injection timing markers. During each engine cycle, the ignition event and the injection event occur, based upon a selected ignition timing marker and a selected injection timing marker.

The three candidate ignition timing markers are: the start-up ignition marker; the adjustable position ignition marker and the fractional piston velocity ignition marker.

The three candidate fuel injection timing markers are: the start-up injection marker; the piston dead point injection marker; and the adjustable position injection marker.

In another aspect, the control system monitors port opening and suppresses fuel injection if a misfire condition has prevented successful ignition of the preexisting charge.

In another aspect, the control system regulates the compression ratio of the engine. Two techniques are used. The first technique monitors piston stroke and regulates air in the bounce chamber to limit maximum piston excursion. The second method uses feedback from a knock sensor to regulate air in the bounce chamber. This second technique limits compression ratio based upon the properties of the fuel. These two compression ratio regulation techniques can be used either simultaneously or independently.

BRIEF DESCRIPTION OF THE DRAWINGS

Throughout the FIGURES of the drawing, three and four digit reference numerals are used to indicate structure, the leading digit for three digit numbers and the leading two digits for four digit numbers, indicate the primary FIGURE number where the referenced item may be found, wherein.

DETAILED DESCRIPTION OF THE PREFERRED EMBODIMENTS

Description of Mechanical Structures

Figure 1:
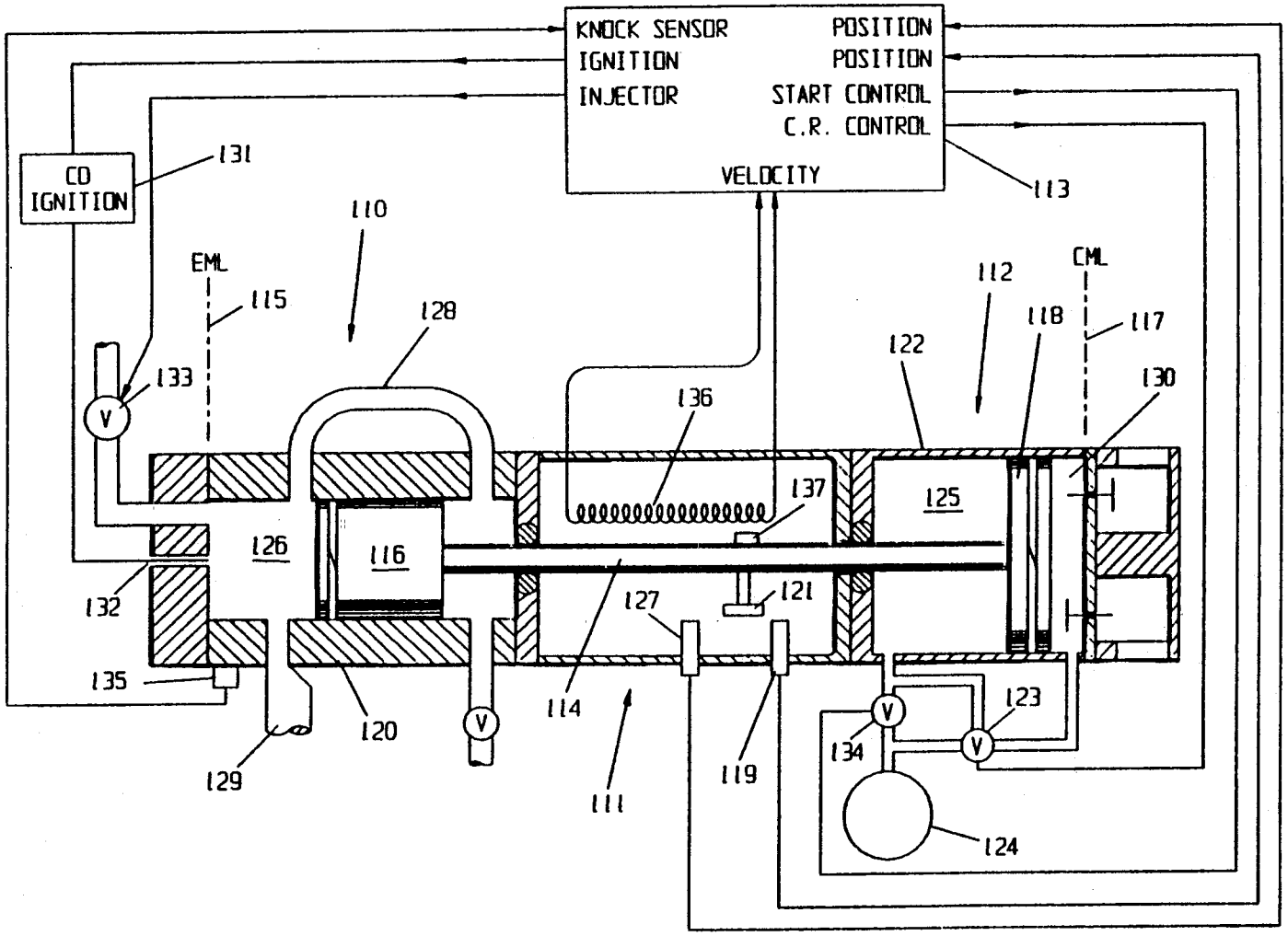
FIG. 1 is a mechanical schematic diagram depicting the mechanical structures of the invention.

FIG. 1 shows a compressor driven by a free piston engine. The engine and compressor are combined into a unitary assembly having a compressor section 112, which is connected to an engine section 110. An intermediate section 111 joins the engine and compressor sections and contains sensors and transducers used by the controller 13.

A piston rod 114 couples the engine piston 116 to the compressor piston 118. This rod passes through the intermediate section 111. Both pistons reciprocate together in appropriate cylinders shown in FIG. 1 as the engine cylinder 120 and the compressor cylinder 122. The engine piston 116, the compressor piston 118 and the piston rod 114 all move together as unit and are called collectively the "reciprocating assembly".

By way of definition, and with reference to FIG. 1, the motion of the engine piston toward the combustion chamber 126 is referred to as "inward", while motion of the compressor piston toward the compressor work space 130 is referred to as "outward".

The reciprocating assembly stops moving, and reverses direction twice during one cycle of engine operation. The point in time when the reciprocating assembly reverses direction is called the "dead point". In FIG. 1, the maximum excursion in the outward direction is shown as the compressor mechanical limit 117 which is abbreviated CML. The corresponding limit in the inward direction is the engine mechanical limit 115 abbreviated EML.

The engine piston 116 is located near the engine mechanical limit (EML) at one reversal time and this is referred to as the "engine dead point" and is abbreviated EDP throughout the specification and drawings.

The compressor piston is located near the compressor mechanical limit (CML) at one reversal point and this is called "compressor dead point" and is abbreviated CDP.

The theoretical "stroke" of a free piston engine can vary from near zero to the maximum length permitted by the physical limits of the engine itself. Clearly, the distance between the CML and EML is the maximum theoretical stroke for the engine. These two geometrical constraints on the motion of the reciprocating assembly, are most readily apparent on FIG. 1.

In operation, actual engine cycles, display stroke lengths that are somewhat shorter than the theoretical maximum. It is also important to note that the relative locations of CDP and EDP with respect to CML and EML can migrate inward or outward, during engine operation.

Figure 3:
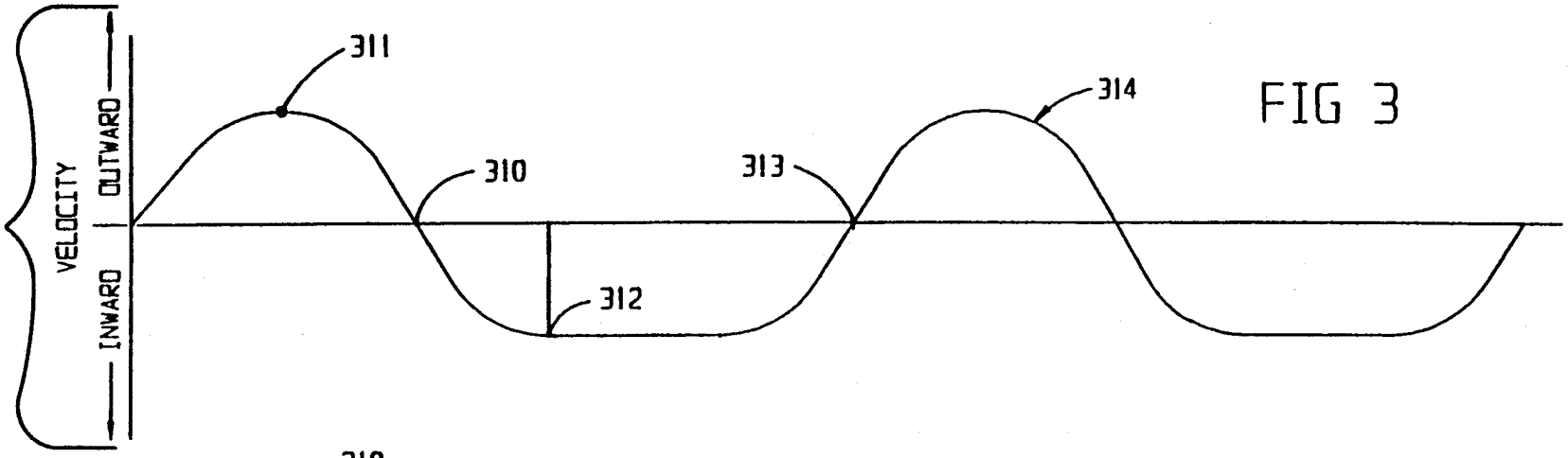
FIG. 3 is a diagram depicting piston velocity as a function of time for the positions set forth in FIG. 2.
Figure 2:
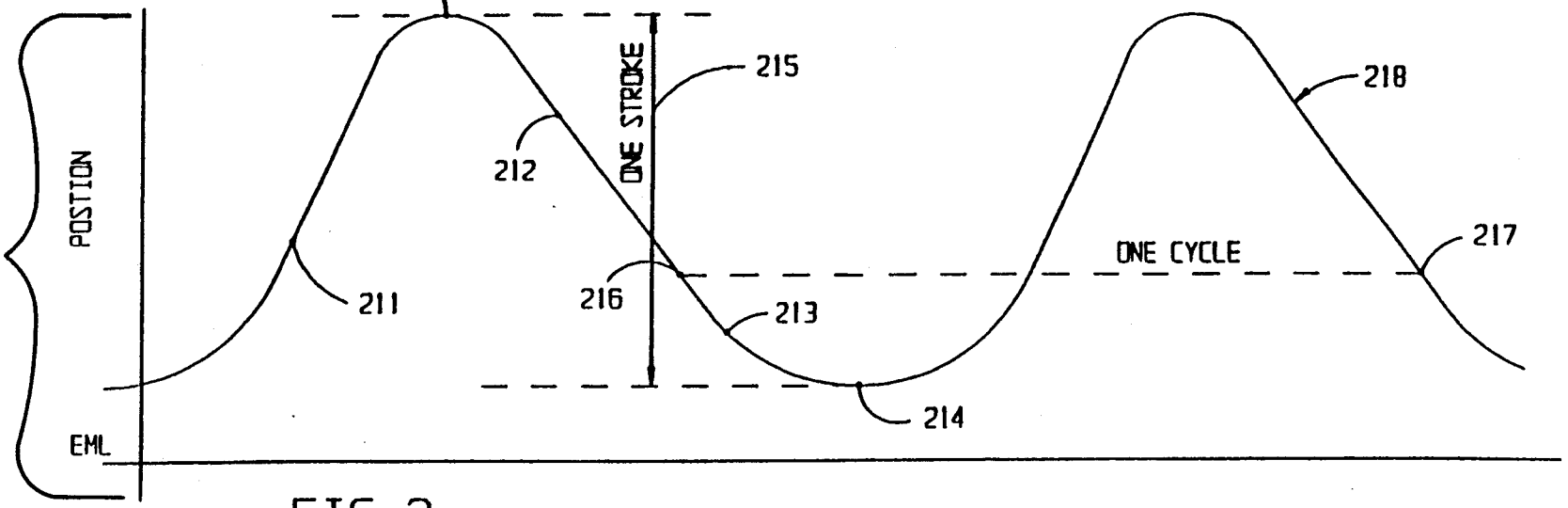
FIG. 2 is a diagram depicting piston position as a function of time for the steady state operating conditions.

The relationship between the position of the reciprocating assembly and the velocity of the reciprocating assembly can be appreciated in connection with FIG. 2 and FIG. 3.

FIG. 2 depicts the position of the reciprocating assembly as a function of time, while FIG. 3 shows the corresponding instantaneous velocity of the reciprocating assembly. These two drawings should be viewed together.

For example, at compressor dead point 210 the velocity of the reciprocating assembly is zero as depicted by point 310. Thus point 310 reflects the reversal of direction of the reciprocating assembly. In a similar fashion, the point at which the reciprocating assembly reaches peak velocity on the outward stroke is shown by point 311. The corresponding location of the reciprocating assembly when peak outward velocity is achieved is shown at point 211. On the inward stroke, the reciprocating assembly reaches maximum velocity at point 312. The reciprocating assembly remains at relatively constant velocity from the location corresponding to point 212 until the location corresponding to point 213, is reached. At position point 213, the reciprocating assembly starts to slow down, reaching the zero velocity point 313 at the engine dead point 214.

The total distance swept out by the engine piston during this cycle of operation is the stroke for that cycle and is indicated on the FIGURES by stroke length 215. In general, the reciprocating motion of the engine piston 116 is approximately sinusoidal, under the steady state conditions, when plotted against time, as shown in FIG. 2.

When considering a single cycle of engine operation it is most convenient to take a point during the expansion stroke, as the "beginning" of a cycle. Such a point is shown as 216. The corresponding point at 217 may be taken as the "ending" of the this cycle, or stroke and the beginning of the next stroke. This convention is followed throughout this description.

Although a variety of engine operating cycles are possible, the engine depicted in FIG. 1, shows the preferred, loop scavenged, piston ported, two cycle, direct injection, spark ignition, engine configuration. Operation of this illustrative operating cycle will be described.

Before an engine "start" is attempted the reciprocating assembly is moved to the extreme compressor end mechanical limit shown as CML 117. Depending on the current position of the engine piston 116 prior to "start", the controller 113 will issue valve control signals to start valve 123 to admit air from reservoir 124 to either the compressor work space 130 or the bounce chamber 125 to move the reciprocating assembly to the CML position 117. This position is detected by sensor 119 in conjunction with target 121.

Target 121 is connected to piston rod 114 portion of the reciprocating assembly, while the switch 119 is fixed along the wall of the intermediate section 111.

With the engine piston 116 correctly positioned, the controller will attempt a "start" by admitting air to the compressor work space 130, driving the engine piston inward on the first compression stroke. As the leading edge of the target 121 passes switch 127, the start-up injection marker is generated and the controller issues a fuel injector control signal to open fuel injector 133. The duration of the fuel injection period is under software control by the controller 113.

As the engine piston 116 continues inward toward the combustion chamber 126, the trailing edge of the target 121 is detected and the start-up ignition marker is generated. The controller 113 issues a control signal to trigger an appropriate capacitive discharge ignition system 131 which will spark the plug 132 several times in rapid succession upon the occurrence of the start-up ignition marker. The principal advantage of the preferred capacitive discharge ignition system 131 is its ability to produce a rapid sequence of ignition events. However, other ignition systems are suitable as well.

If the mixture in the combustion chamber 126 is ignited on this start attempt, the engine will be running. If the attempt is unsuccessful, the controller will recycle the reciprocating assembly to the CML and another start will be attempted.

Figure 4:
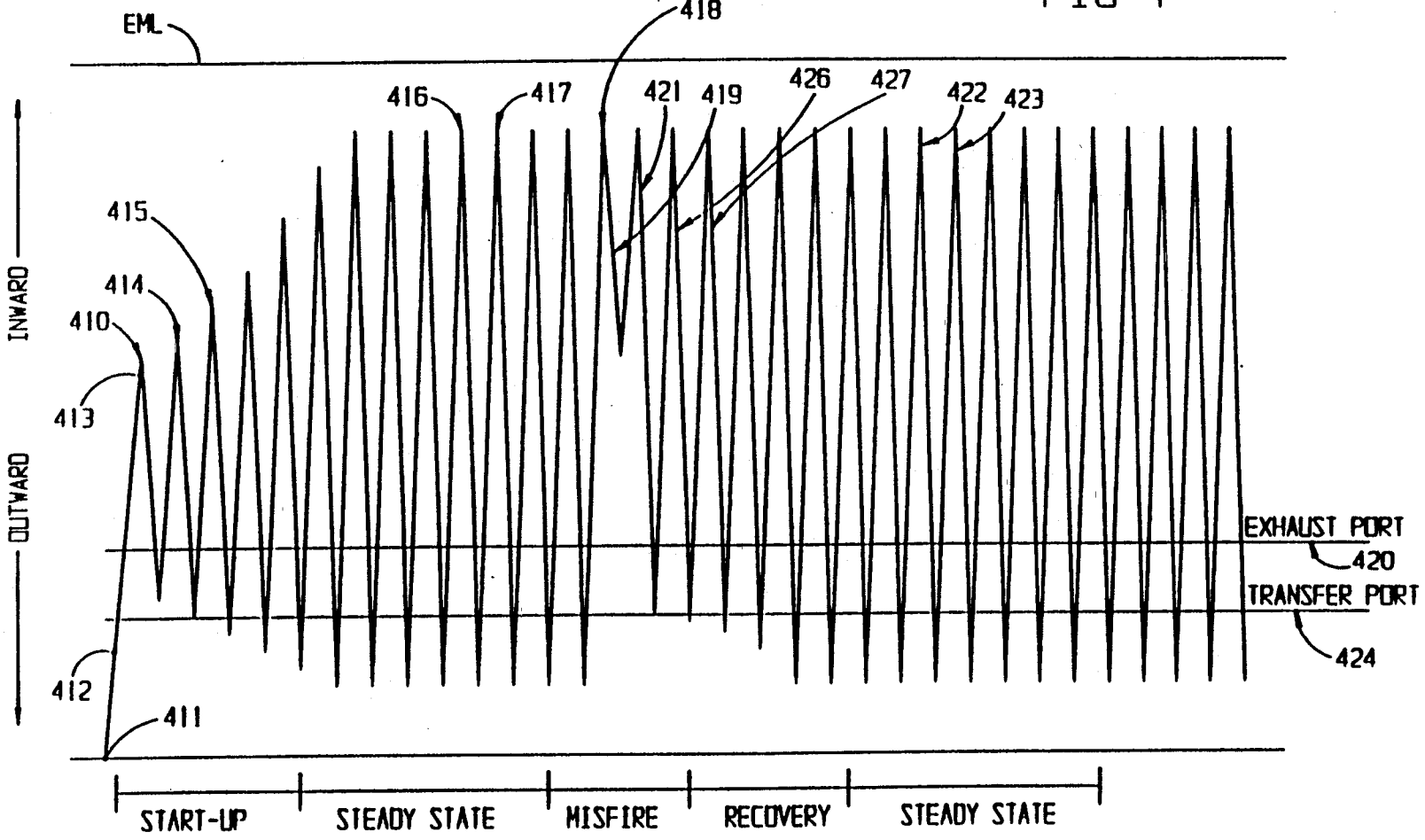
FIG. 4 is a diagram depicting stroke excursion as a function of time for engine cycles occurring during engine start-up, operation at steady state, during misfire and during recovery from misfire.

A successful start cycle is shown on FIG. 4 by engine cycle 410, where the reciprocating assembly is moved inward from the CML start point 411, by air pressure from the reservoir 124. The start-up injection event occurs on cycle 410 at a fixed location corresponding to point 412, while the start-up ignition event 413 are determined experimentally. In the illustrative embodiments, the location of switch 127 in the intermediate section 111, and the size of target 121 determine the locations for these events.

Figure 5:
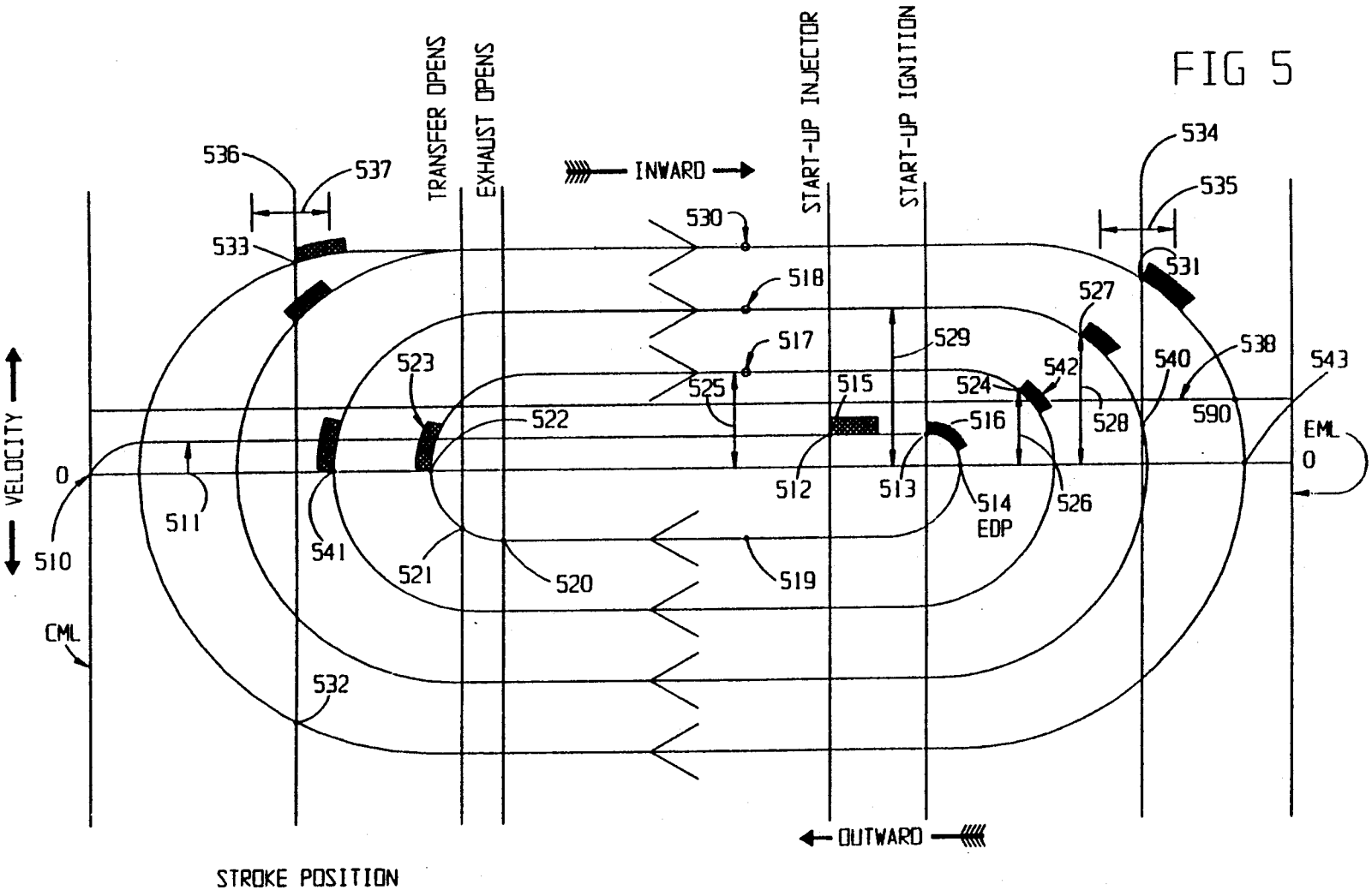
FIG. 5 is a diagram depicting stroke velocity as a function of stroke position.

The first start-up cycle is also shown in a different format in FIG. 5. Once again the reciprocating assembly starts at zero velocity at the CML location. Point 510 depicts the reciprocating assembly at this velocity and at this location.

The engine piston is driven inward at a low velocity depicts in the drawing by arrow 511. The first start-up injection event occurs at 512 in the FIGURE. The block 515 depicts the duration of the fuel injection time. While the first start-up ignition event occurs at point 513, with the block 516 indicating multiple ignition events, issued from the capacitive discharge system 131.

With successful ignition the reciprocating assembly quickly reaches the engine dead point 514 and then accelerates quickly in the outward direction.

Once the engine has started, the stroke lengths for the subsequent engine cycles become longer. This is most readily seen in connection with FIG. 4 where the strokes for transitional cycles 414 and 415 increase dramatically. In this instance, fuel injection timing and ignition timing are not generated by the switch 127 and target 121. In this transient operating regime the fractional piston velocity ignition timing marker is used and the fuel is injected based upon the piston dead point injection marker.

The ignition and injection processes require consideration of FIG. 5 where two transitional cycles 517 and 518 are depicted. The underlying physical engine processes discussed may be understood in connection with FIG. 1.

In FIG. 5, consideration of the transitional cycle 517 begins at point 519, during the expansion portion of the cycle. At this point the reciprocating assembly is moving outward. As the piston uncovers the exhaust port 129, the exhaust gases blow down and begin the scavenging process. The exhaust port opening position corresponds to point 520. Shortly thereafter the transfer port 128 is uncovered as indicated by point 521.

During transitional cycle 517, fuel injection is initiated at compressor piston dead point 522. The duration of the fuel injection period is shown by duration block 523. It is important to note that in the transitional regime, the injection timing mark is based upon detection of the reversal or compressor dead point.

Ignition for this cycle 517 occurs at point 524 and a collection of spark events indicated by duration block 542 begin at this point. This location is determined by first measuring or deriving the maximum velocity of the reciprocating assembly on the inward stroke. This maximum value, is shown on the FIGURE by arrow 525. When the reciprocating assembly slows to a designated fraction of the maximum value an ignition timing marker is generated. This fractional value is shown on the FIGURE by arrow 526. In this fashion a fractional velocity ignition marker is generated. The optimal "fraction" is determined experimentally for each engine, however values of approximately four to six tenths are typical.

Transitional cycle 518 also results in a fractional piston velocity ignition event at point 527 when the engine piston slows to a fraction, represented by arrow 528, of the maximum velocity for that cycle, which is represented by arrow 529.

Cycle 530 shown on FIG. 5 represents strokes occurring during steady state operation such as those depicted on FIG. 4 by reference numerals 416, 417, 422, 423.

The ignition event for cycle 530 occurs at point 531, while the injection event for the cycle is initiated at point 533. The ignition event for cycle 530 is based upon the adjustable position ignition timing marker while the injection event begins with the occurrence of the variable position fuel injection marker 533.

On FIG. 5 the adjustable position ignition marker is generated when the engine piston 116 crosses the stroke location indicated by line 534. Although this location is typically "fixed" it may be readily adjusted as indicated by arrow 535. In the illustrative embodiments of the controller 113 this value is set manually, empirically and does not change during engine operation. However, if additional engine data is available the adjustable ignition marker can be adjusted on the fly. Illustrative candidate data for adjustment feedback include, exhaust gas composition, and engine temperature. It should be apparent that other data may be used to adjust this parameter as well.

In a similar fashion the adjustable position injection marker is generated when the engine piston crosses the stroke position location indicated by line 536. This location maybe adjusted over a range indicated by arrow 537.

With these concepts understood the benefit of the control system may be explained as follows. Transitional cycles having short stroke lengths require an appropriate ignition "advance curve" to insure that peak combustion pressure occurs at an appropriate time with respect to the engine dead point for the particular cycle under consideration. The fractional piston velocity ignition marker achieves this objective on a stroke by stroke basis and permits stable operation in this transitional cycle regime.

However, once the engine is operating in a steady state, engine operation is stabilized by fixing ignition at the fixed location provided by the adjustable position ignition marker. Changeover from fractional piston velocity ignition to the adjustable position based ignition can conveniently be provided by firing the ignition system 131 on the first ignition marker to occur.

The fixed velocity ignition line 538 provides a comparison between the invention and prior art fixed velocity ignition systems. In the prior art this velocity level must be low enough to intersect with low excursion strokes to provide reliable starting. However, this low velocity provides a too retarded ignition point for strokes with a larger excursion. For example, fixed velocity ignition point 540 for cycle 518 would be "retarded" with respect to the fractional velocity ignition point 527. This progressively retarded ignition point is undesirable as well as it may lead to loss of power and excessive exhaust temperature.

The controller provides similar benefits for fuel injection timing. In general, the fuel must be injected early in the stroke to insure good mixing. At low engine speeds associated with short strokes and transitional cycles 517 and 518, injection at the reversal points 522 and 541 permit good mixing without excessive cross-scavenging or loss of fuel out the open exhaust port. While adjustable position injection at point 533, for steady state cycle 530 promotes operational stability of the engine. In the sense of FIG. 5 changeover to adjustable position ignition and adjustable position injection tends to stabilize the locations of the strokes between the mechanical limits of CML and EML. In this sense the changeover process "centers" the strokes and limits the migration or variability of the location of the "dead points" from cycle-to-cycle.

The controller also adapts the fuel injection process to compensate for misfires.

On FIG. 4, cycle 418 has suffered a misfire from a fouled plug or the like. As a consequence, the expansion stroke 419 has insufficient energy to force the engine piston 116 outward, to uncover the exhaust port 129. This condition is reflected in the diagram by the failure of the stroke path to intersect the exhaust port open position indicated by line 420.

In the case where the exhaust port 129 has not been uncovered by piston motion, the controller suppresses fuel injection to prevent a too rich mixture from forming in the combustion chamber. Consequently, there is no fuel injection on cycle 421.

Recovery cycles 426 and 427 uncover the exhaust and transfer port indicated in the drawing by intersection with exhaust port level 420 and transfer port level 424. Therefore, these strokes will undergo adjustable position based fuel injection, and fractional piston velocity ignition.

Of the many operating variables, compression ratio is the most significant for economy of operation and reduction of emissions. In the present invention, two methods of compression ratio control are taught. The result of this compression ratio regulation process may be understood by considering movement of the steady state cycle 530 between the CML and EML, on FIG. 5. In essence, each compression ratio regulation process controls the size of the clearance space formed between the crown of the engine piston 116 and the combustion chamber 126. In the geometric sense, the compression ratio control process regulates the distance between engine dead point (EDP) location and the engine mechanical limit (EML).

The first compression regulation control method uses a piston position setpoint, to control compression ratio. In operation, if the measured piston excursion approaches the engine mechanical limit EML, additional air is admitted to the bounce chamber 125 through bounce valve 134. This results in increased pressure in the bounce chamber 125 which moves the piston away from the engine mechanical limit EML.

The second method of compression ration control involves knock feedback. The knock sensor 135 monitors the mechanical vibrations due to incipient knock or knock and can be used to reduce compression ratio in the presence of incipient knock or knock. This system is closed loop and can maximize the compression ratio for a given fuel composition. In operation, the position of the engine dead point 543 for cycle 530 dithers about the "knock point" compression ratio, or "knock point" engine piston position.

The relationship between the controller 113 and the engine is depicted schematically in FIG. 1. In general, the controller 113 acquires information from the engine system and generates certain control outputs to operate the engine, and its ancillaries.

The controller acquires the following inputs: absolute piston location information from the switches 119 and 127 and target 121; knock sensor data from the knock sensor 135; and piston velocity information from the coil 136 and magnet 137.

The controller generates the following outputs: ignition timing trigger to fire spark plug 132, injection timing signals to control fuel injector 133; bounce valve control signals to operate bounce valve 134, and start valve control signals to operate start valve 123.

The controller 113 itself is partitioned into a microprocessor based control subsystem and a hardware subsystem. The hardware subsystem generates "interrupts". The microprocessor services the interrupts and generates the control signal outputs for the controller 113. This is a hybrid digital/analog and hybrid hardware/software system. There is great flexibility in the partitioning of the analog and digital subsystems and there is great flexibility in the assignment of tasks and partitioning of the system between hardware and software. Therefore, the controller embodiments depicted and described should be considered illustrative of, rather than limiting, the scope of the invention.

Figure 7:
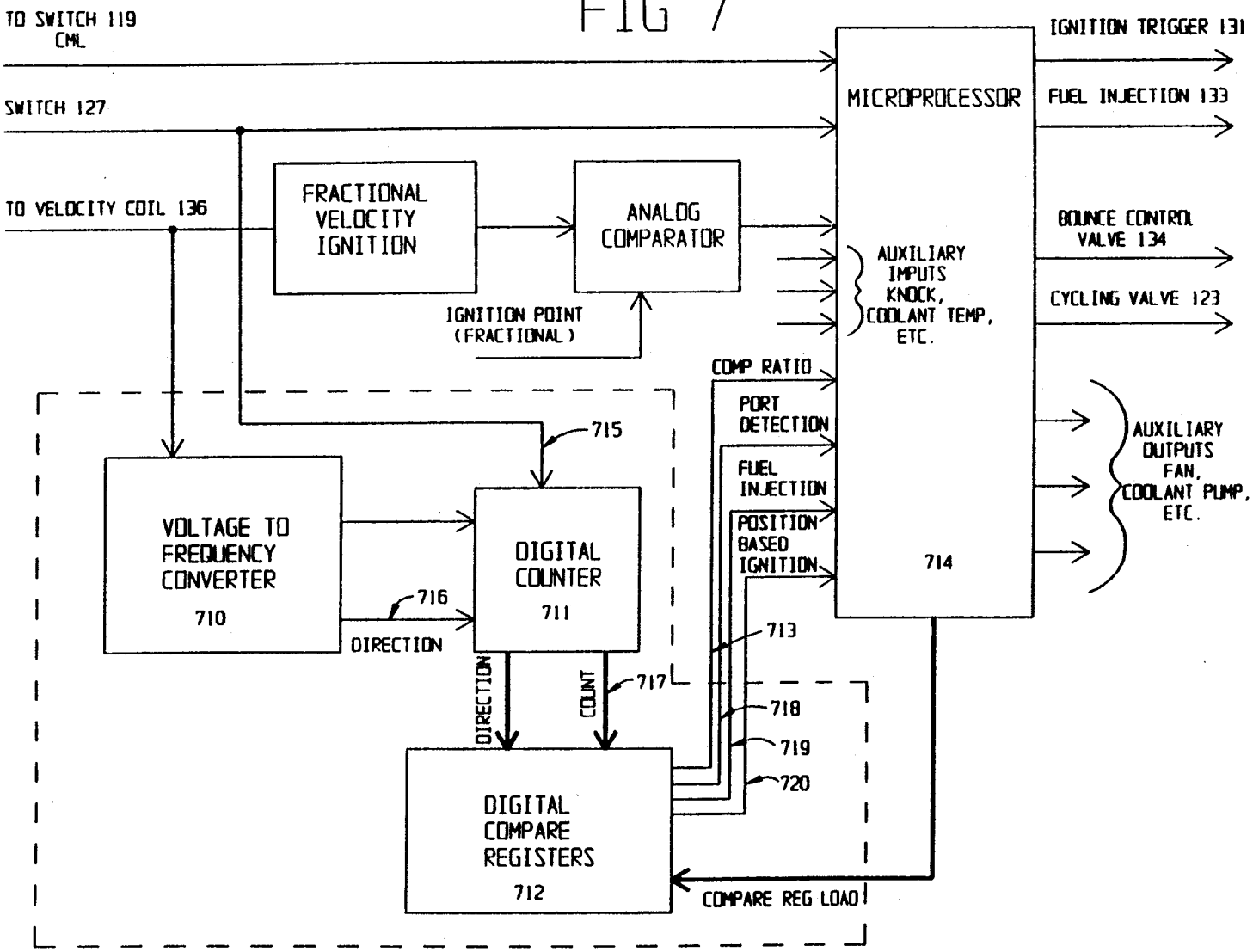
FIG. 7 is a diagram depicting a block level schematic for an illustrative implementation of the control system.
Figure 8:
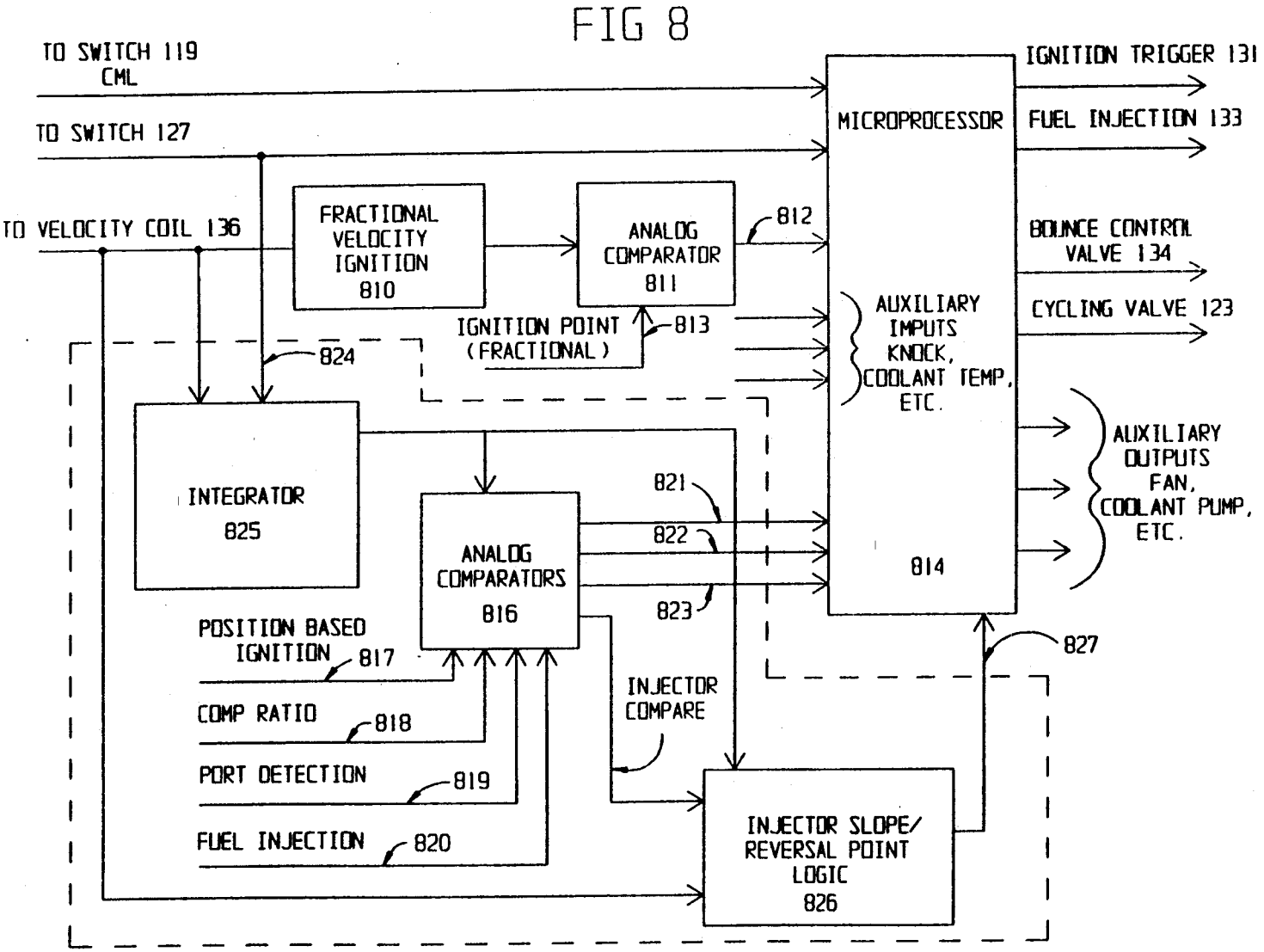
FIG. 8 is a diagram depicting a block level schematic for an illustrative implementation of the control system.

Two specific embodiments of the controller are shown in FIG. 7 and FIG. 8, which differ in hardware architecture but not in overall functionality.

First, the two embodiments of the hardware subsystem will be described. Then, the software tasks will be described.

In each embodiment, the hardware subsystem monitors the piston velocity and generates a fractional piston velocity marker used as an interrupt.

In each embodiment, the hardware subsystem generates a representation of piston position. Various position setpoints are established in hardware and when these positions are reached, interrupts are issued to the microprocessor. These "position" interrupts correspond to: the adjustable position injection marker; the adjustable position ignition marker; the port position marker; the compression ratio piston position marker. Hardware also generates an interrupt when the piston dead point is reached. Two additional flags are set by switches 119 and 127.

Both the FIG. 7 and FIG. 8 embodiments are identical with respect to the fractional piston velocity ignition marker subsystem. In each, an AC signal is developed by the passage of a magnet 137 past a coil of wire 136. This system generates an AC voltage which reflects the instantaneous velocity of the reciprocating assembly. Other transducers can be used to develop a velocity signal. However, the coil and magnet arrangement is preferred because it is robust, reliable, and inexpensive.

Turning to FIG. 8 the peak voltage level from the coil is detected by detector 810, then divided as specified by analog input 813 and compared to the changing velocity signal from the coil through the analog comparator circuit 811. When the instantaneous velocity coil voltage is reduced to reaches the setpoint, the comparator generates an interrupt 812 to the microprocessor 814.

It is preferred to develop the required piston position data from the velocity signal. Two methods are taught herein. The first is depicted in FIG. 8.

In the FIG. 8 embodiment, piston position is derived by analog integration of the velocity signal by integrator 825, which produces an integrated signal representing the piston position. This integrated signal waveform is displayed in FIG. 2 as waveform 218, while the corresponding velocity signal from the coil 136 is set forth in FIG. 3 as waveform 314.

This position signal is then compared with setpoints through a set of analog comparators 816. A number of separate position setpoints are defined for use by the system. In this embodiment analog voltage levels can be used to set an adjustable position based ignition marker 817, a compression ratio set point 818, a port detection set point 819, and an adjustable position fuel injection marker 820. These voltage setpoints can be generated by manually adjusted potentionmeters or by digital-to-analog (D/A) converters driven by a digital system. When an analog comparison is reached, an appropriate interrupt is generated such as the adjustable position ignition interrupt 821, compression ratio piston position interrupt 822 or port detection interrupt 823, or the injection point interrupt 827.

The analog integrator 825 must be reset periodically to prevent drift. It is preferred to reset the integrator with the periodic signal from the switch 127, via path 824. Other periodic signal sources could be used as well.

Figure 6:
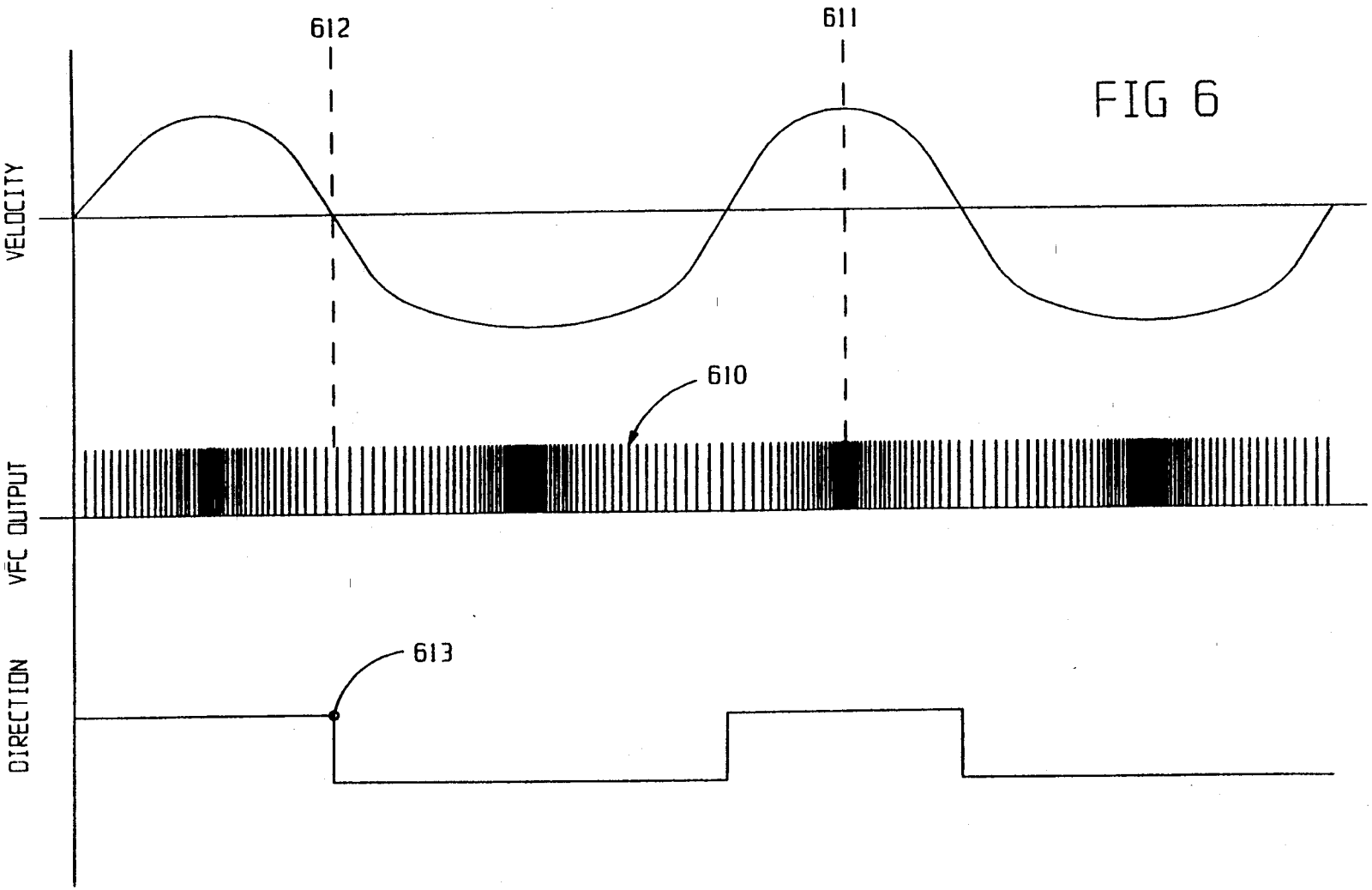
FIG. 6 is diagram depicting an illustrative method of converting analog velocity data in to a digital format.

In an alternate embodiment piston position may also be derived through a voltage-to-frequency converter (VFC) 710, as shown in connection with FIG. 7. In this embodiment the velocity signal from coil 136 is used as the input to a voltage-to-frequency convertor 710 which produces a series of pulses as shown in FIG. 6 as 610. The time between any two pulses is determined by the amplitude of the velocity signal.

When the velocity is at its peak 611, the pulses are close together. When the velocity is at zero at 612, the time between the pulses is the greatest. The time interval between the pulses will vary as shown in FIG. 6 but the piston displacement represented by each pulse is constant and equal throughout the stroke.

This string of pulses 611, from the voltage-to-frequency convertor, is then counted with digital counter 711. The counter adds counts as the piston moves toward EML and subtracts counts as it moves toward CML. Thus at any given instant, the counter 711 contains a count value reflecting and indicating current piston position. A collection of compare registers 712 are loaded with setpoint values corresponding to piston positions for ignition, injection and other events. These register values are compared to the value in the counter and a set of interrupts, 713,718 719 and 720 are generated to the microprocessor when a match occurs. In this embodiment a fixed reference point signal from switch 127 is used as a fixed reference point to reset the counter, via path 715. This counter reset eliminates errors caused by false counts generated by noise or other electrical sources, and is analogous to the reset of the integrator 825 in the analog embodiment of FIG. 8.

Detection of dead point is performed in the analog embodiment of FIG. 8 by the injector slope reversal logic 826. In operation, the velocity signal from the coil 136 is differentiated to find the instant in time when the slope reverses. At this point an appropriate logic level signal is generated as interrupt 827. This slope data corresponds to the direction, inward or outward of the piston. Since injection may also occur at a position setpoint, the appropriate setpoint comparison data is also provided to the logic 826. As a result and, with reference steady state stroke 530 on FIG. 5, the adjustable position injection interrupt 827 is selectable between point 532 on the outward stroke or at 533 on the inward stroke.

In the digital hardware embodiment of FIG. 7, the voltage to frequency convertor 710 generates an up/-down direction signal 716 which is used to control the counter 711. This direction signal 716 corresponds to waveform 613 on FIG. 6 and corresponds to the dead point marker. This signal 716 along with counter data 717 is supplied to the comparison registers 712 to generate the appropriate position and or deadpoint markers as an interrupt 719, to the microprocessor 714.

The executive program selects among the various tasks based upon the state of these various interrupts.

Figure 9:
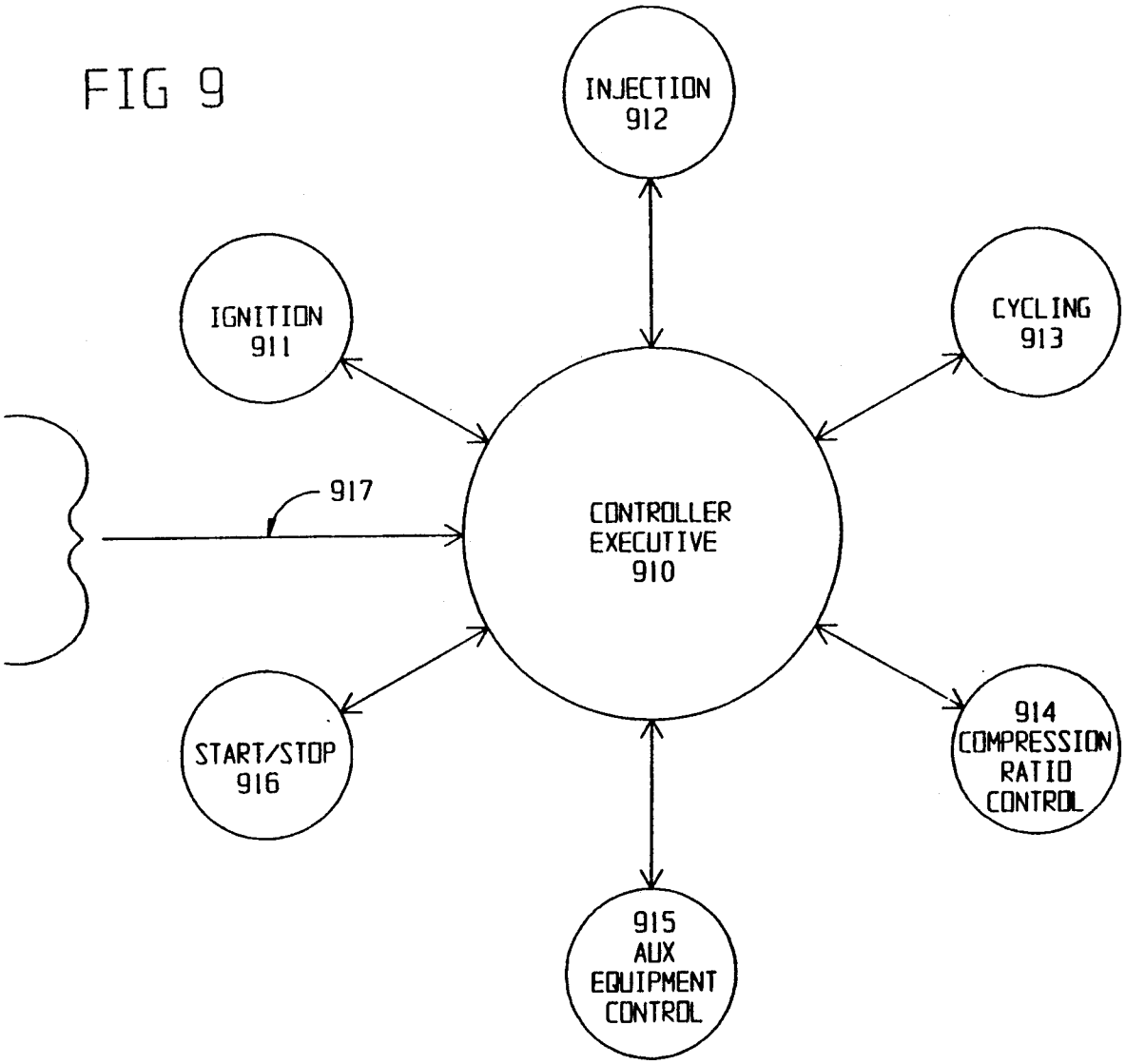
FIG. 9 is a diagram illustrating an illustrative partitioning of the system software.

A software flow chart and description is given for the engine control tasks. As set forth in FIG. 9, the executive program 910 controls the execution of certain tasks set forth as: ignition task 911, injection task 912, cycling task 913, compression ratio control task 914, ancillary equipment control task 915, and engine start/stop control task 916.

These tasks are prioritized and selected based upon interrupts which are generated by engine events, or by the time out of a real time clock. Collectively these interrupts are shown in the drawing at 917. The ancillary and housekeeping tasks are identified but not described since these are application specific not required for a complete understanding of the invention and are readily designed by one of ordinary skill in this art.

Ignition Control Task

Figure 10:
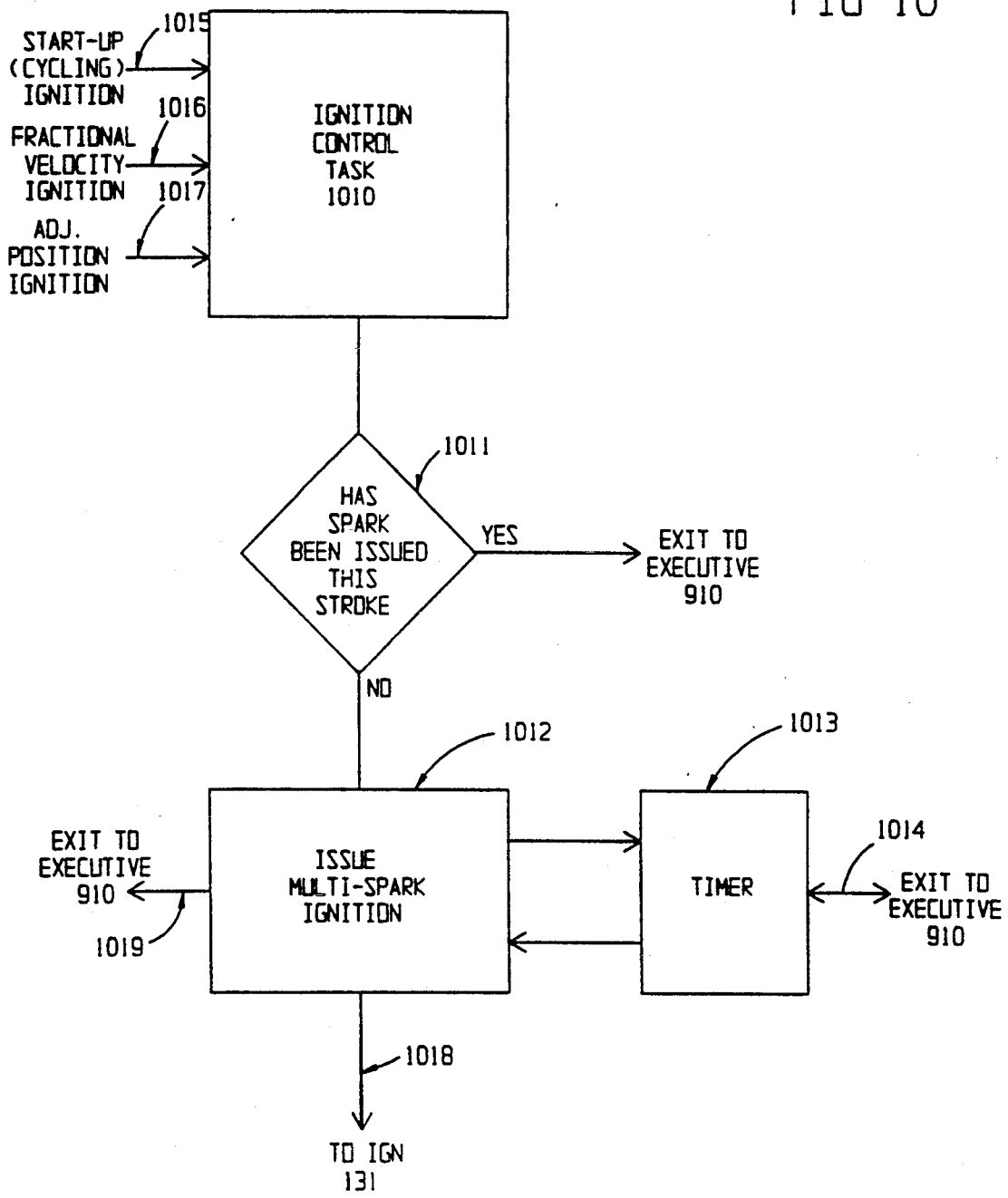
FIG. 10 is a flowchart depicting the ignition software module.
Figure 11:
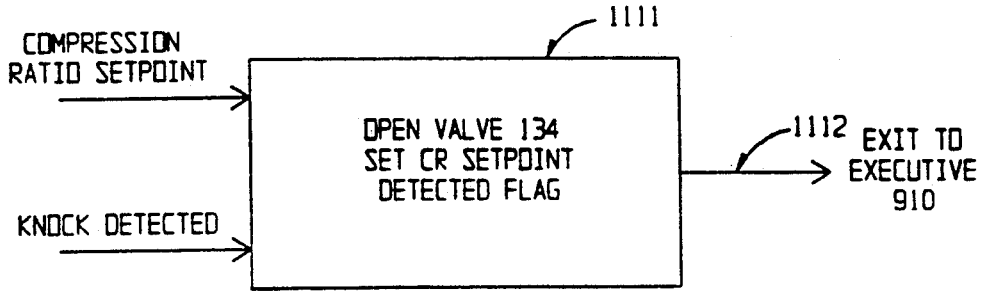
FIG. 11 is a flowchart depicting the compression ratio control software module; and, FIG. 12 is a flowchart depicting the fuel injection control software module.
Figure 11:
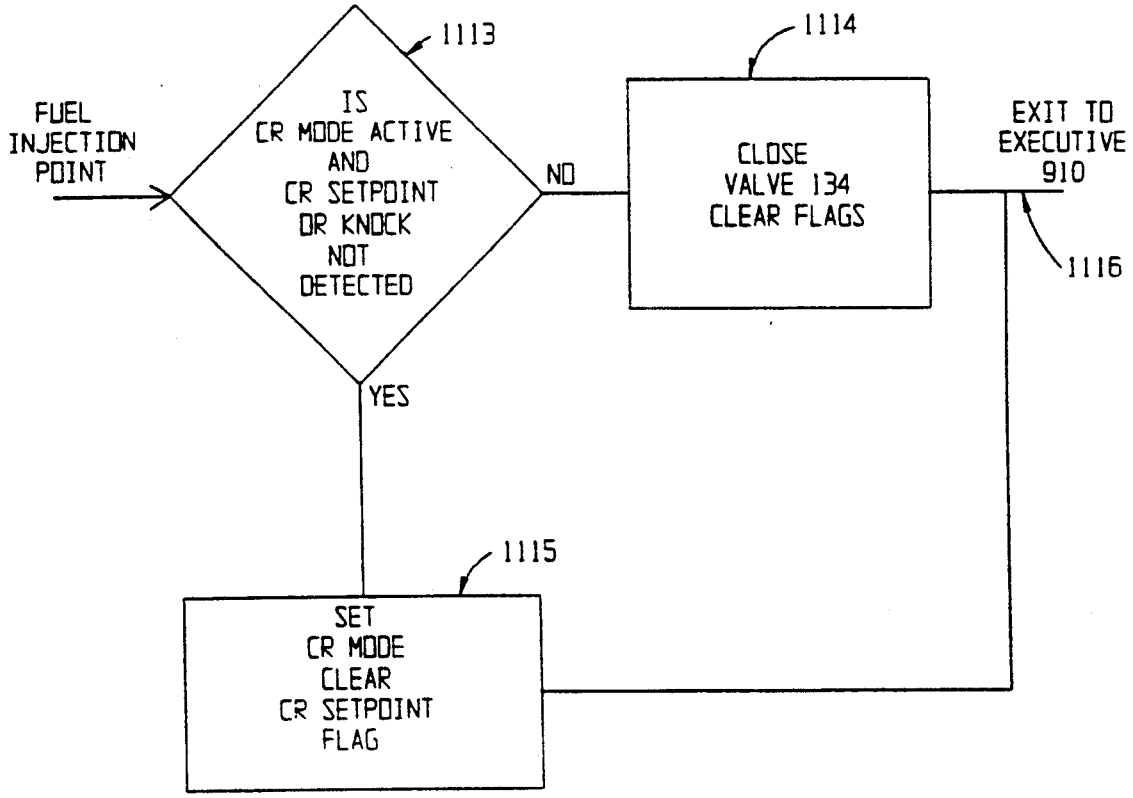

The fractional piston velocity ignition marker is generated by the hardware as is the adjustable position ignition timing marker. In a similar fashion the target 121 and switch 119 generate a start-up ignition timing marker. Consequently the microprocessor needs to executes only a simple control program to select between these various ignition times and to promptly generate the ignition events. The preferred and illustrative task is depicted in FIG. 10. Typically, the process 1010 will receive only one of the input markers 1015, 1016, or 1017 at a time. Therefore process 1011 must first check whether a spark has been issued for that particular cycle. If the required ignition event has occurred, the process 1011 defaults back to the executive 910. If ignition has not taken place, a timer 1013 is started and the first ignition event is started via 1018. After the last programmed ignition event, the task 1010 defaults to the executive 910 via 1019.

Compression Ratio Control

As previously discussed, the compression ratio of a free piston engine is an operating variable which can be adjusted to optimize engine performance. In the present invention two sources of data can be used to control the compression ratio.

In the first control method, a piston position setpoint is selected, and if the piston excursions reach this point, the process 1111, opens the bounce valve 134, and sets a software flag indicative of the fact that the piston exceeded the setpoint. The bounce valve admits air to the bounce chamber to increase pressure and move the engine piston away from EML. The valve is closed after the position setpoint is not reached. The task then defaults to the executive 910 via path 1112.

At the fuel injection point for the next cycle, the process 1113 checks to see if the piston limit setpoint is violated. If the piston has approached the EML too closely, the bounce valve 134 remains open and the flag is reset in process 1115. Path 1116 returns control to the to the executive 910.

This task is used to set an upper bound on compression ratio. A setpoint is set via setpoint control 818 and if the engine reaches this position the compression ratio task is entered and the bounce control chamber pressure is regulated via control of bounce valve 134. When the setpoint is no longer reached the process 1114 closes the bounce valve 134 and clears the flags.

In the knock 135 feedback regime, the same logic, lowers the compression ratio the presence of incipient knock. After several knock free cycles the compression ratio may be increased so that the engine operates below the knock limited compression ratio.

Fuel Injection Control Task

Figure 12:
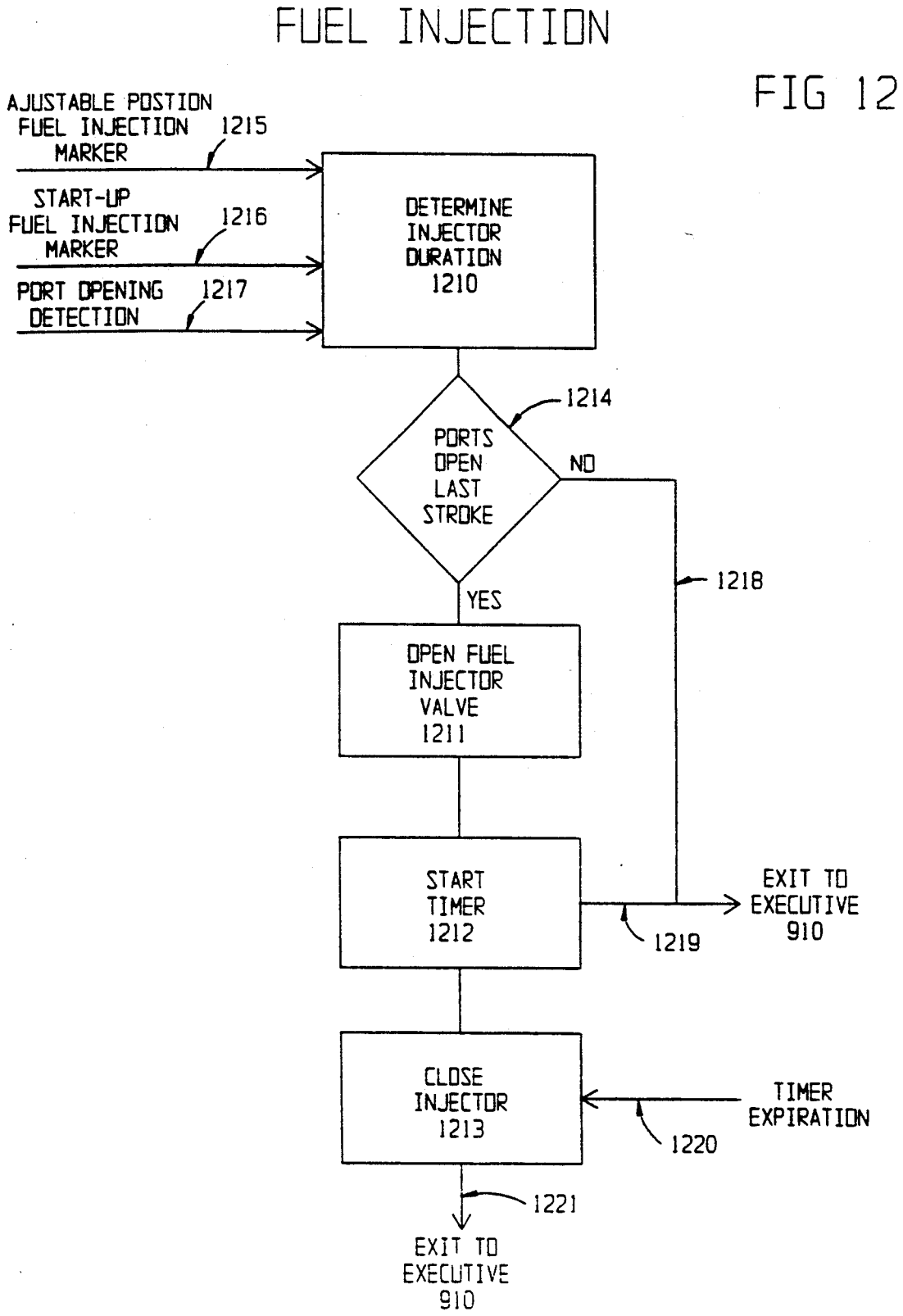

One of three position based interrupts invokes entry in to the fuel injection task 912. With reference to FIG. 12 these interrupts are set forth in the drawing as the adjustable position fuel injection marker 1215, the startup fuel injection marker 1216, and the port detection event 1217.

The first process 1210 selects and sets a total injection time duration. The appropriate duration is depicted FIG.5 by the duration blocks such as 523. Next process 1214 checks to see if the stroke has been long enough to uncover the exhaust and transfer ports. If the ports have not opened then the combustion chamber should still contain combustible mixture and no injection is required. In this event process 1214 defaults to the executive 910 via path 1218.

Next if injection is required, process 1211 opens the fuel injection valve 133. A timer is loaded with the duration value in process 1212. This task then exits to the executive via path 1219. When the timer times out indicating that the injection valve should be closed the process is reentered at path 1220 and the injector is closed. Completion of this injection task ultimately returns to the executive via path 1221.

Although the invention is described in detail there are numerous modifications which can be made to the invention without departing from either the scope or spirit of the invention. Consequently, the embodiments shown are only illustrative of the invention and the scope should be determined from the claims which set forth the invention.

We claim:

1. A free piston control system, for use with a variable stroke free piston engine of the type having, an engine piston, an engine cyclinder, said engine piston and cylinder defining a combustion chamber, said control system comprising:

means for defining a first ignition event marker, based upon the velocity of said piston;

means for defining a second ignition event marker, based upon the position of said piston;

selection means for generating an ignition event in said combustion chamber upon the first to occur of said first ignition marker and said second ignition marker.

2. A free piston control system, for use with a variable stroke free piston engine of the type having, an engine piston, an engine cylinder, said engine piston and cylinder defining a combustion chamber, said control system comprising:

transducer means for generating a velocity signal representative of the velocity of said engine piston;

detecting means coupled to said transducer means for determining the maximum velocity of said engine piston;

setpoint means coupled to said detecting means, for defining an ignition velocity, said ignition velocity being a fraction less than unity, of said maximum engine piston velocity;

comparing means coupled to said detecting means and coupled to said setpoint means for determining when said engine piston has slowed to said ignition velocity:

triggering means, coupled to said comparing means, for generating an ignition event in said combustion chamber when said engine piston slows to the ignition velocity.

3. The control apparatus of claim 2 wherein said detecting means further comprises:

means for detecting said maximum engine piston velocity on the inward stroke of said piston.

4. The control apparatus of claim 2 wherein said transducer means comprises:

magnet means coupled to a reciprocating portion of said engine, for following motion of said piston;

coil means located proximate said magnet means for transducing magnet motion into a signal indicative of piston velocity.

5. A free piston control system, for use with a variable stroke free piston engine of the type having, an engine piston, an engine cylinder, said piston and cylinder defining a combustion chamber, comprising:

transducer means for generating a velocity signal representative of the velocity of said piston;

detecting means coupled to said velocity means for determining the maximum velocity of said piston;

fractional piston velocity ignition setpoint means for defining an ignition velocity, said ignition velocity being a fraction less than unity, of said maximum inward piston velocity;

comparison means for generating a first fractional velocity ignition marker when said piston slows to the ignition velocity, on the inward compression stroke of said piston;

position measuring means for generating a piston position signal;

position ignition setpoint means for defining a position ignition setpoint;

comparison means for comparing said piston position with said position ignition setpoint and for generating a second piston position ignition marker when said piston reaches said position ignition setpoint;

selection means for triggering an ignition event in said combustion chamber upon the first to occur of said first ignition marker and said second ignition marker.

6. A free piston control system, for use with a variable stroke free piston engine of the type having, an engine piston, an engine cylinder, said piston and cylinder defining a combustion chamber, comprising:

velocity measurement means for generating a velocity signal representative of the velocity of said piston;

detecting means coupled to said velocity means for determining the maximum velocity of said piston;

fractional velocity ignition setpoint means for defining an ignition velocity, said ignition velocity being a fraction, less than unity, of said maximum piston velocity;

triggering means for generating a first fractional velocity ignition when said piston slow to the ignition velocity, on the inward compression stroke of said piston;

position measuring means coupled to said velocity measuring means for generating a piston position derived from said velocity measurement;

position ignition setpoint means for defining a position ignition setpoint, and for defining a stroke threshold;

comparison means for comparing said piston position with said position ignition setpoint and for generating an ignition triffer when said piston reaches said position ignition setpoint;

selection means for triggering ignition at said velocity ignition time for strokes shorter than a first threshold stroke and for triggering ignition at said position ignition time, for strokes longer than said threshold stroke.

7. A free piston control system, for use with a variable stroke free piston engine of the type having, an engine piston, an engine cylinder, said piston and cylinder defining a combustion chamber, comprising:

velocity measurement means for generating a velocity signal representative of the velocity of said piston;

position measuring means coupled to said velocity measuring means for generating a piston position derived from said velocity measurement;

fuel injection setpoint means for defining a fuel injection setpoint;

comparison means for comparing said piston position with said fuel injection setpoint and for generating a fuel injection trigger when said piston reaches said fuel injection setpoint.

8. A free piston control system, for use with a variable stroke free piston engine of the type having, an engine piston, an engine cylinder, said piston and cylinder defining a combustion chamber, comprising:

transducer means for generating a velocity signal representative of the velocity of said piston;

position measuring means coupled to said transducer means for generating a piston position derived from said velocity measurement;

fuel injection setpoint means for defining a fuel injection setpoint;

comparison means for comparing said piston position with said fuel injection setpoint and for generating a fuel injection trigger when said piston reaches said fuel injection setpoint;

piston direction reversal detection means for finding the point at which the piston changes direction;

selection means responsive to piston stroke for selecting fuel injection based upon piston position or piston reversal depending on the magnitude of the stroke of said piston.

9. A free piston control system, for use with a variable stroke free piston engine of the type having, an engine piston, an engine cylinder, said piston and cylinder defining a combustion chamber, comprising:

velocity measurement means for generating a velocity signal representative of the velocity of said piston;

position measuring means coupled to said velocity measuring means for generating a piston position derived from said velocity measurement;

fuel injection setpoint means for defining a fuel injection setpoint and for setting a stroke setpoint;

comparison means for comparing said piston position with said fuel injection setpoint and for generating a fuel injection trigger when said piston reaches said fuel injection setpoint;

exhaust port detection means for determining whether said piston has uncovered exhaust port;

injection suppression means responsive to said exhaust port detection means for suppressing fuel injection in cycles where the previous cycle has failed to uncover said exhaust port.

10. A free piston control system, for use with a variable stroke free piston engine comprising:

piston velocity detection means for generating a piston velocity signal;

piston position detection means for generating a piston position signal, from said piston velocity detection means;

setpoint definition means for setting one or more piston position setpoints and for setting one or more piston velocity setpoints;

computing means for generating ignition and fuel injection control events as a function of said setpoints and for selecting ignition event by comparing the relative occurrence of said piston position setpoint and said piston velocity setpoint, and for selecting said injection event by comparing the relative occurrence of said piston velocity or said piston position setpoint.

* * * * *